US006825598B2

(12) United States Patent
Koh et al.

(10) Patent No.: US 6,825,598 B2
(45) Date of Patent: Nov. 30, 2004

(54) TENSION MASK WITH INNER SHIELD STRUCTURE FOR CATHODE RAY TUBE

(75) Inventors: Hyang-Jin Koh, Suwon (KR); Seong-Seob Kim, Yongin (KR); Jong-Heon Kim, Suwon (KR); Tae-Yong Kim, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 4 days.

(21) Appl. No.: 10/342,073

(22) Filed: Jan. 13, 2003

(65) Prior Publication Data

US 2003/0146683 A1 Aug. 7, 2003

(30) Foreign Application Priority Data

Jan. 29, 2002 (KR) ..... 2002-5018

(51) Int. Cl.[7] ..... H01J 29/80

(52) U.S. Cl. ..... 313/402; 313/404; 313/407; 313/408

(58) Field of Search ..... 313/402, 404, 313/406, 407, 408

(56) References Cited

U.S. PATENT DOCUMENTS

| | | | | |
|---|---|---|---|---|
| 4,580,076 A | * | 4/1986 | Shimoma et al. | 313/402 |
| 4,971,590 A | * | 11/1990 | Tong | 445/47 |
| 5,196,761 A | * | 3/1993 | Majima et al. | 313/402 |
| 5,871,851 A | | 2/1999 | Fukumizu et al. | |
| 6,600,259 B1 | * | 7/2003 | Ono et al. | 313/402 |

FOREIGN PATENT DOCUMENTS

| | | |
|---|---|---|
| KR | 1998-077085 | 11/1998 |
| KR | 1998-077086 | 11/1998 |
| KR | 1998-077087 | 11/1998 |
| KR | 1998-077088 | 11/1998 |
| KR | 199-026171 | 4/1999 |

OTHER PUBLICATIONS

Korean Patent Abstract, Publication No. 1020000252946, Published on Jan. 21, 2000, in the name of LG Electronics Inc.

Korean Patent Abstract, Publication No. 1020000252945, Published on Jan. 21, 2000, in the name of LG Electronics Inc.

Korean Patent Abstract, Publication No. 1020000252940, Published on Jan. 21, 2000, in the name of LG Electronics Inc.

Korean Patent Abstract, Publication No. 1019990232138, Published on Sep. 3, 1999, in the name of LG Electronics Inc.

Korean Patent Abstract, Publication No. 1020000253008, Published on Jan. 21, 2000, in the name of LG Electronics Inc.

* cited by examiner

*Primary Examiner*—Ashok Patel
*Assistant Examiner*—Kevin Quarterman
(74) *Attorney, Agent, or Firm*—Christie, Parker and Hale, LLP

(57) ABSTRACT

A tension mask cathode ray tube has a vacuum tube and an inner shield mounted within the vacuum tube to shield the vacuum tube from geomagnetism. A value Br/Hc of the inner shield where Br indicates a residual magnetic flux density and Hc indicates a coercive force is established to be 1.0–2.0 times more than a value Br/Hc of the mask frame. In this structure, the route of electron beams is established to be more precise. Consequently, the purity characteristic and the convergence characteristic are improved while forming a precise raster. In this way, the display screen quality can be enhanced.

18 Claims, 4 Drawing Sheets

(1 of 4 Drawing Sheet(s) Filed in Color)

TENSION MASK WITH INNER SHIELD STRUCTURE FOR CATHODE RAY TUBE

CROSS REFERENCE TO RELATED APPLICATION

This application claims priority to application No. 2002-0005018, filed in the Korean Intellectual Property Office on Jan. 29, 2002 the disclosure of which is incorporated hereinto by reference.

BACKGROUND OF THE INVENTION (a) Field of the Invention

The present invention relates to a cathode ray tube with a tension mask wherein tensional strength is applied in uni-axial or bi-axial directions, and more particularly, to a tension mask cathode ray tube with an inner shield capable of minimizing variation in the landing of the electron beam due to geomagnetism.

(b) Description of the Related Art

Generally, a cathode ray tube is a display device wherein three electron beams are scanned on a phosphor screen to thereby display a desired picture image. The route of each electron beam is varied with the axes of north and south poles of the earth, due to geomagnetism. The electron beam is influenced by a purity characteristic, a raster position, and a convergence characteristic.

The geomagnetic field is divided into a vertical force (the vertical geomagnetic field) perpendicular to the earth's surface, and a horizontal force (the horizontal geomagnetic field) parallel to the earth's surface. The geomagnetic field involves different values depending upon the location thereof on the earth. With the cathode ray tube, the movement of the electron beam due to the horizontal geomagnetic field may be shown to be divided into an NS movement factor and an EW movement factor, with respect to the cathode ray tube axis.

The NS movement refers to the movement of the electron beam due to the horizontal geomagnetic field corresponding to the tube axis of the cathode ray tube, while the EW movement refers to the movement of the electron beam due to the horizontal geomagnetic field perpendicular to the tube axis of the cathode ray tube.

The amount of variation in the landing position of the electron beam displayed at the screen under the influence of the geomagnetic field may be shown to be divided into a horizontal component and a vertical component.

Both with a shadow mask for a color picture tube for public use with a longitudinal slot in the vertical direction, and a shadow mask for a color display tube for industrial use with dot-type holes, the electron beam becomes distant from the designated slot or hole due to the horizontal movement component thereof. Accordingly, it is critical to prohibit the horizontal movement component.

Typically an inner shield is mounted within the cathode ray tube to reduce the amount of variation in the landing position of the electron beam due to the geomagnetic field. In the case of a cathode ray tube with a mask formed by way of press-forming (referred to hereinafter as the formed mask cathode ray tube), the inner shield is fabricated using a high magnetic permeable material, thereby reducing the movement scale of the electron beam due to the geomagnetic field.

As shown in FIG. 1A, in the case a cylindrical shield 110 is made using two materials 112 bearing the same magnetic permeability, the magnetic force line of the geomagnetic field passes through the inside of the materials 112 as indicated by the arrows. Consequently, the internal magnetic field of the shield 110 is stabilized.

By contrast, as shown in FIG. 1B, in the case a cylindrical shield 110' is made using a high magnetic permeability material 112 and a low magnetic permeability material 114 (the permeability thereof being 1/10 of the high magnetic permeability material), leakage of the magnetic field occurs at the interface 116 between the two materials 112 and 114 as indicated by the arrows. Consequently, the internal magnetic field of the shield 110' becomes non-uniform while reducing the shielding effect.

In the case of a formed mask cathode ray tube, the initial magnetic permeability $\mu_{0.35}$ of the mask is about 600, and the maximum magnetic permeability $\mu_{max}$ thereof is about 3200. The material for the mask frame used to hold the formed mask has an initial magnetic permeability $\mu_{0.35}$ of 800 or more, and the maximum magnetic permeability $\mu_{max}$ thereof is 4000–8000.

The initial magnetic permeability is a value measured at a magnetic flux density of 350 mG.

Therefore, when the material for the inner shield has the same magnetic permeability as the mask frame, as shown in FIG. 1A, the magnetic force flows smoothly while increasing the shielding efficiency, as with the case where the two materials 112 bearing the same magnetic permeability are coupled to each other. In this way, the movement scale of the electron beam is reduced.

Korean Patent Publication Nos. 1998-077085 to 077088 and 1999-026171 disclose a method of improving the magnetic permeability of the inner shield material by way of heat treatment.

However, with a cathode ray tube using a tension mask (referred to hereinafter as the tension mask cathode ray tube), as the tension mask and the mask frame for holding the mask must bear a high force, the magnetic permeability of the material for the tension mask and the mask frame is less than that of the formed mask cathode ray tube.

Table 1 illustrates the magnetic characteristics of a usual tension mask and a mask frame. The magnetic characteristics are measured under a condition such that the tension mask and the mask frame are blackened at 460° C., the tension mask is tensioned in the uni-axial or bi-axial directions with a force of 15 kgf/mm$^2$ or more, and they are mounted within the cathode ray tube. In Table 1, Hc indicates the coercive force, and Br indicates the residual magnetic flux density.

TABLE 1

| | Magnetic characteristic | | | | | Remark Material |
|---|---|---|---|---|---|---|
| | $\mu_{0.35}$ | $\mu_{max}$ | Hc (Oe) | Br (kG) | Br/Hc | name |
| Tension mask | 120 | 970 | 4.9 | 9.7 | 1.98 | NSF |
| Mask frame | 150 | 1080 | 5.4 | 11.6 | 2.15 | SCM415 |

As illustrated in Table 1, the tension mask and the mask frame exhibit a magnetic permeability $\mu$ of about 20% of the relevant parts of the formed mask cathode ray tube.

Accordingly, when a high magnetic permeable inner shield is mounted to a tension mask cathode ray tube, the phenomenon illustrated in FIG. 1B occurs. That is, with the use of a high magnetic permeable inner shield, a low magnetic permeable tension mask, and a mask frame, the shielding effect of the inner shield may be satisfactorily produced, but variations in the local magnetism distribution occur due to leakage of the magnetic field at the portion where the inner shield is welded to the frame. Consequently, the movement scale of the electron beam is increased.

For this reason, in the case of a tension mask cathode ray tube, another characteristic value is required in order to select the inner shield material in addition to the magnetic permeability $\mu$, which is the characteristic value used in the formed mask cathode ray tube.

U.S. Pat. No. 5,871,851 discloses that the value of multiplying the coercive force Hc by the residual magnetic flux density Br is taken as the characteristic value for discriminating the desired inner shield material. With the inner shield formed using a material bearing the predetermined specific value (Hc×Br), the movement of the geomagnetic field can be minimized in the tension mask cathode ray tube. Preferably, the specific value of Hc×Br is established to be 28 or more.

However, according to the experiments of the present inventor, as shown in FIG. 2, in the case the specific value of Hc×Br is 60 or more, the movement scale of the electron beam is reduced with the increase in the specific value of Hc×Br. By contrast, in the case the specific value of Hc×Br is 80 or more, the movement scale of the electron beam is rather enlarged. In FIG. 2, the solid line indicates the value of 0.5(NS+EW), and the dotted line indicates the value of NS+EW.

As indicated in FIG. 2 by the solid line, the value of 0.5(NS+EW) indicates the value of NS+EW at the location where the target moves by ½ the distance vertically proceeding from the diagonal end of the cathode ray tube to the horizontal center axis of the screen. In the case of a formed mask cathode ray tube, the value of NS+EW exhibits the maximum value at the diagonal area. By contrast, in the case of a tension mask cathode ray tube, the movement of the geomagnetic field exhibits the maximum value at the location where the target moves by ½ of the distance vertically proceeding from the diagonal end of the cathode ray tube to the horizontal center axis of the screen.

Accordingly, the specific value of Hc×Br disclosed in U.S. Pat. No. 5,871,851 is not effective in selecting the inner shield material.

SUMMARY OF THE INVENTION

It is an object of the present invention to provide a tension mask cathode ray tube with a geomagnetism-shielding inner shield which minimizes variation in the landing position of the electron beam due to the geomagnetic field.

This and other objects may be achieved by a tension mask cathode ray tube. The tension mask cathode ray tube is provided with a tension mask for color-selecting electron beams emitted from an electron gun, and a mask frame holds the tension mask such that the tension mask is tensioned in a uni-axial direction or in bi-axial directions. An inner shield is fixed to the mask frame to shield geomagnetism. A specific value Br/Hc of the inner shield where Br indicates the residual magnetic flux density and Hc indicates the coercive force is established to be 1.0–2.0 times more than the specific value Br/Hc of the mask frame, or to be 1.0–2.5 times more than the specific value Br/Hc of the tension mask. Alternatively, the specific value Br/Hc of the inner shield may be established to be 1.0–2.0 times more than the specific value Br/Hc of the mask frame while being 1.0–2.5 times more than the specific value Br/Hc of the tension mask.

The mask frame is formed with a material bearing a coercive force Hc of 3.0 Oe or more. With the tension mask cathode ray tube, a tensional strength of 15 kgf/mm$^2$ or more should be applied to the tension mask. Particularly, the cathode ray tube should bear a reasonable rigidity at a high temperature of 450° C. or more during the steps of blackening and sealing. Therefore, a material bearing a high temperature-resistant rigid material should be used to form the mask frame. Such a material involves a higher carbon content and a smaller grain size, and hence, the coercive force Hc thereof reaches 3.0 Oe or more. In the case a material bearing a coercive force Hc of less than 3.0 Oe is used to form the mask frame, a predetermined tensional strength required for the tension mask cathode ray tube cannot be applied to the tension mask.

The tension mask is formed with a material bearing a magnetic permeability of 300 or less at 350 mG. The tension mask should endure a tensional force of 15 kgf/mm$^2$ or more, and a reasonable rigidity at a high temperature of 450° C. or more during the step of blackening. For that purpose, a full hard material is usually introduced that can bear a coercive force Hc of 3.0 Oe or more, with an initial magnetic permeability of 300 or less (the permeability at 350 mG). In the case a material bearing an initial permeability of more than 300 is used to form the mask, a predetermined degree of tensional strength cannot be applied to the mask. The tension mask may have a thickness of 0.05–0.20 mm.

With the formed mask cathode ray tube, a material with a thickness of 0.15 mm has been extensively used to form the inner shield. However, with the tension mask cathode ray tube, the weight of the mask and the mask frame reaches 6 kg or more, which is two times more than that of the formed mask cathode ray tube. The inner shield because it has a thickness of 0.20–0.50 mm and a predetermined degree of strength must endure the weight of the mask and the frame during the process of manufacturing the cathode ray tube.

The tension mask is tensioned with a tensional strength such that the degree of strength at the periphery of the tension mask is greater than the degree of strength at the center of the tension mask, or the degree of strength at the center of the tension mask is greater than the degree of strength at the periphery of the tension mask. The cathode ray tube further includes a vacuum tube having a panel with a phosphor screen, a funnel sealed to the panel, and a neck connected to the funnel. An electron gun is mounted within the neck, while a deflection yoke deflects the electron beams emitted from the electron gun.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

A more complete appreciation of the invention, and many of the attendant advantages thereof, will be readily apparent as the same becomes better understood by reference to the following detailed description when considered in conjunction with the accompanying drawings, in which like reference symbols indicate the same or the similar components, wherein.

DETAILED DESCRIPTION OF THE PREFERRED EMBODIMENTS

Embodiments of this invention will be explained with reference to the accompanying drawings.

Figure 1A:
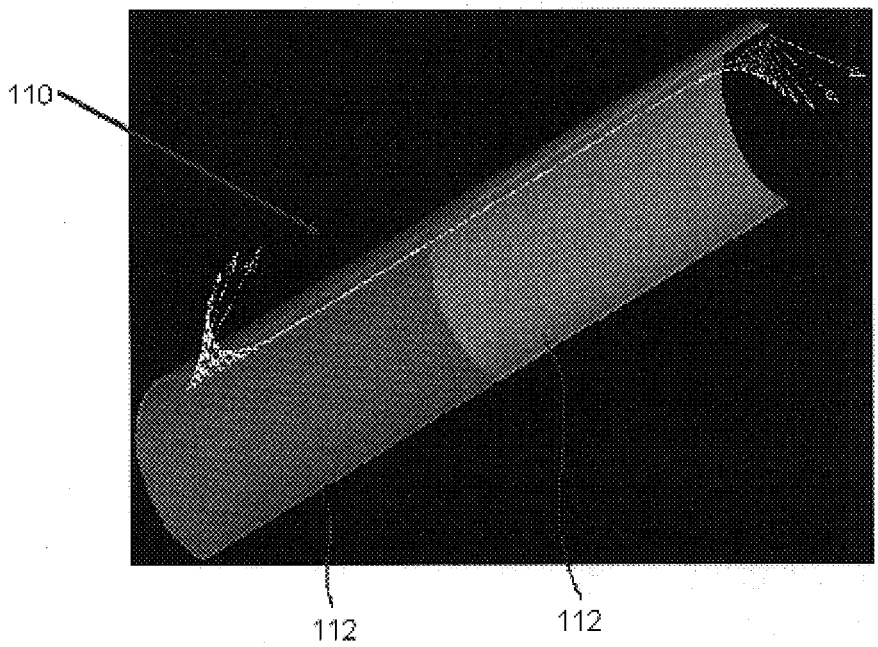
FIG. 1A illustrates the direction and size of the internal magnetic field generated in the inner shield where two materials bearing the same magnetic permeability are coupled to each other.
Figure 1B:
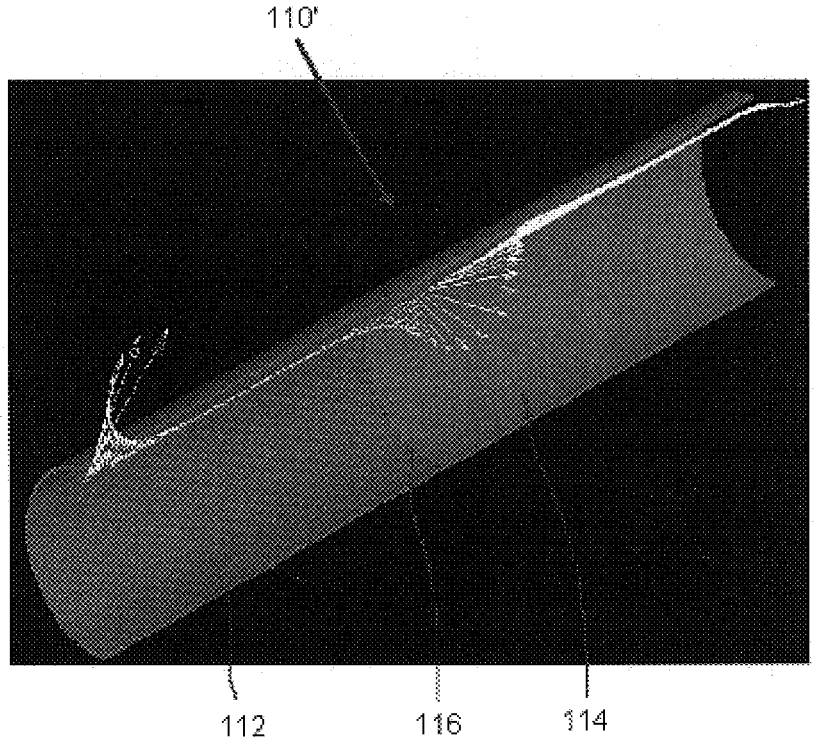
FIG. 1B illustrates the direction and size of the internal magnetic field generated in the inner shield where two materials differentiated in magnetic permeability are coupled to each other.
Figure 2:
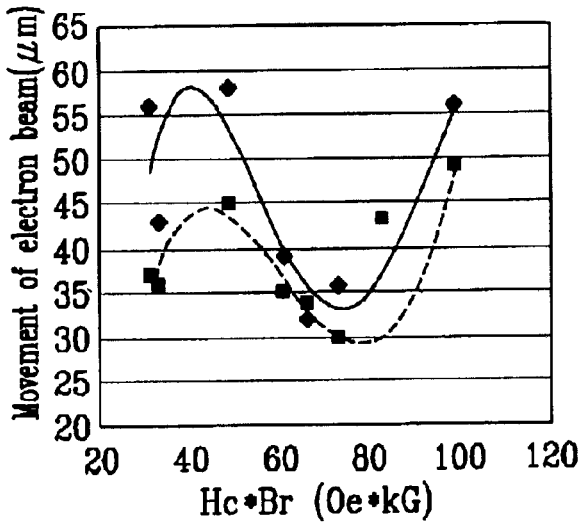
FIG. 2 is a graph illustrating the movement of the electron beam as a function of the characteristic value (Hc×Br) of the inner shield material, according to prior art.
Figure 3:
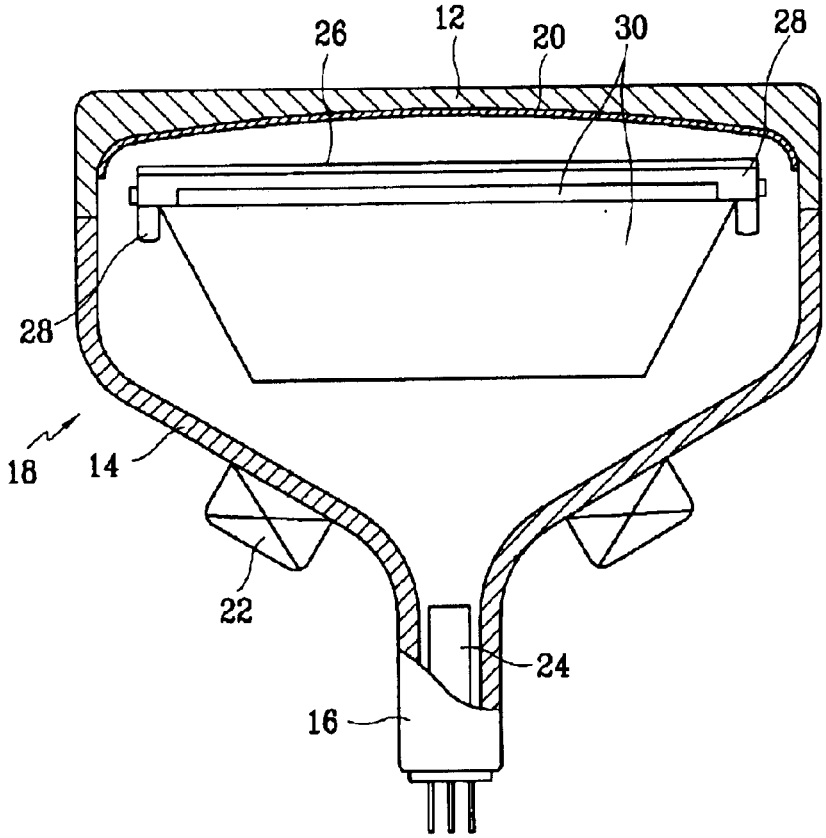
FIG. 3 is a sectional view of a tension mask cathode ray tube with an inner shield, according to an embodiment of the present invention.
Figure 4A:
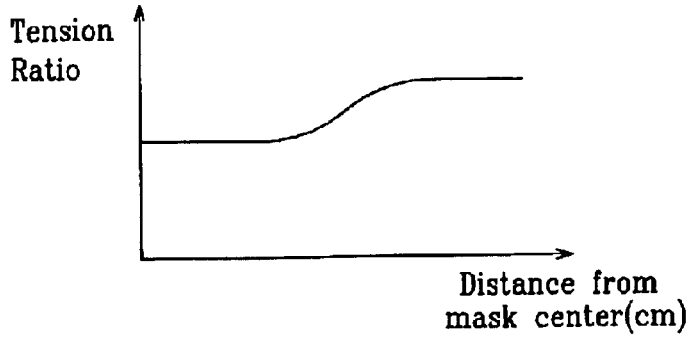
FIGS. 4A and 4B illustrate the distribution of the tensional strength applied to the tension mask.
Figure 4B:
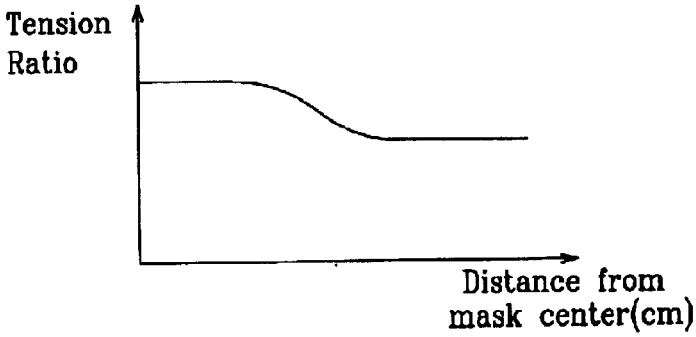

FIG. 3 is a sectional view of a tension mask cathode ray tube with an inner shield, and FIGS. 4A and 4B are graphs illustrating the distribution of the tensional strength applied to the tension mask.

As shown in FIG. 3, the cathode ray tube is formed with a vacuum tube 18 where a panel 12, a funnel 14, and a neck 16 are incorporated as one body. A phosphor screen 20 is formed at the inner surface of the panel 12, with a plurality of R, G, and B phosphors. A deflection yoke 22 is mounted around the funnel 14, and an electron gun 24 is mounted within the neck 16.

A tension mask 26 with a plurality of beam-guide holes is fitted to a mask frame 28, and mounted within the tube 18 such that it faces the phosphor screen 20.

The tension mask 26 is fitted to the mask frame 28 while being tensioned in a uni-axial (long axis) direction or in bi-axial (long and short axes) directions. As shown in FIG. 4A, the tension mask 26 is tensioned with a tensional strength where the strength degree at the mask periphery is greater that that of the mask center, or with a tensional strength where the strength degree of the mask center is greater than that of the mask periphery shown in FIG. 4B.

With the above structure, when three electron beams are emitted from the electron gun 24 in correspondence with the picture signals, the electron beams are deflected by the magnetic field of the deflection yoke while forming a raster on the screen. The R, G, and B electron beams are selected by way of the tension mask 26, and land on the correct phosphors, thereby displaying the desired picture image.

In this way, the electron beams form a designated raster by the deflection magnetic field. The three electron beams pass through the correct beam-guide holes while realizing excellent convergence characteristics. That is, the electron beams should move along a designated route to make the desired picture image.

An inner shield 30 is fitted to the mask frame 28 at its one end, and it is mounted within the vacuum tube 18 while surrounding the route of the electron beam. The inner shield 30 prevents the geomagnetic field from influencing the movement of the electron beam by a predetermined degree.

However, in the tension mask cathode ray tube, special attention must be given to selecting the material for the inner shield 30.

With one embodiment of the present invention, a new characteristic value capable of being used for selecting the inner shield material enhances the definition of the tension mask cathode ray tube.

As described earlier, a factor influencing the smooth magnetic field flux in the route of inner shield—mask frame—tension mask can be assumed to be the "magnetic permeability." It is difficult or impossible to precisely measure the permeability of the low magnetic permeability material and utilize the measurement result as the evaluation data. Particularly, the initial permeability is extremely sensitive to the measurement facility and conditions. Therefore, it is difficult to use the initial permeability as the evaluation standard.

Figure 5:
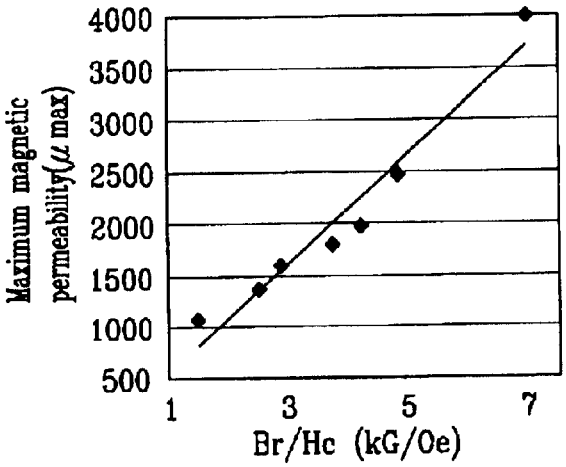
FIG. 5 is a graph illustrating the relation of the maximum magnetic permeability to the characteristic value of Br/Hc, according to an embodiment of the present invention.

In this respect, the present inventor investigated what characteristic value could be used in the predetermined functional relationship of the maximum permeability $\mu_{max}$. It was found that the relative value of the residual magnetic flux density (Br) to the coercive force (Hc) is a factor in the predetermined relationship of the maximum permeability $\mu_{max}$. This is illustrated in FIG. 5.

Table 2 illustrates the magnetic characteristics of the materials for the inner shield 30, and table 3 illustrates the results of measuring the movement of the electron beam with the inner shield formed using the materials. The comparative material 1 is a material containing about 0.002 wt % of carbon C, about 0.10 wt % of manganese Mn, about 0.005 wt % of silicon Si, and about 0.01 wt % of aluminum Al. The comparative material 2 is a material containing about 0.035 wt % of carbon C, about 0.25 wt % of manganese Mn, about 0.01 wt % of silicon Si, and about 0.036 wt % of aluminum Al. The comparative example 3 is a material containing about 0.064 wt % of carbon C, about 0.35 wt % of manganese Mn, about 0.01 wt % of silicon Si, and about 0.036 wt % of aluminum Al. The comparative material 4 is a material containing about 0.003 wt % of carbon C, about 0.15 wt % of manganese Mn, about 0.005 wt % of silicon Si, and about 0.048 wt % of aluminum Al.

TABLE 2

| | Blackening | Magnetic characteristic | | | | | | | |
|---|---|---|---|---|---|---|---|---|---|
| | temperature (° C.) | $\mu_{max}$ | Hc (Oe) | Br (kG) | Hcx Br | Br/ Hc | Ratio 1 | Ratio 2 | Remark |
| Comparative material 1 | 460 | 1790 | 4.03 | 15.10 | 60.9 | 3.75 | 1.74 | 1.89 | FH |
| | 580 | 3997 | 2.12 | 14.78 | 31.3 | 6.97 | 3.24 | 3.52 | |

TABLE 2-continued

| | Blackening temperature (° C.) | Magnetic characteristic $\mu_{max}$ | Hc (Oe) | Br (kG) | Hcx Br | Br/Hc | Ratio 1 | Ratio 2 | Remark |
|---|---|---|---|---|---|---|---|---|---|
| Comparative material 2 | 460 | 1200 | 8.10 | 12.25 | 99.2 | 1.51 | 0.70 | 0.76 | FH |
| | 580 | 2448 | 3.16 | 15.34 | 48.5 | 4.85 | 2.26 | 2.45 | CR |
| Comparative material 3 | 460 | 1362 | 5.38 | 13.62 | 73.3 | 2.53 | 1.18 | 1.28 | CR |
| | 580 | 1607 | 4.79 | 13.83 | 66.3 | 2.89 | 1.34 | 1.46 | |
| Comparative material 4 | Non-blackening | 1975 | 2.80 | 11.81 | 33.2 | 4.23 | 1.97 | 2.14 | Cr |

TABLE 3

| | Blackening temperature (° C.) | Movement of electron beams ($\mu$m) (½)EW | EW | (½)NS | NS | (½)TOTAL | TOTAL |
|---|---|---|---|---|---|---|---|
| Comparative material 1 | 460 | 15 | 21 | 24 | 14 | 39 | 35 |
| | 580 | 35 | 25 | 21 | 12 | 56 | 37 |
| Comparative material 2 | 460 | 19 | 21 | 37 | 28 | 56 | 49 |
| | 580 | 34 | 32 | 24 | 13 | 58 | 45 |
| Comparative material 3 | 460 | 13 | 17 | 23 | 13 | 36 | 30 |
| | 580 | 19 | 21 | 23 | 13 | 32 | 34 |
| Comparative material 4 | Non-blackening | 20 | 23 | 23 | 13 | 43 | 36 |

In Table 2, full hard (FH) material indicates a material that undergoes cold rolling but not annealing, cold rolled (CR) material indicates a material that undergoes cold rolling, annealing, and temper rolling, and Cr material indicates a material coated with chrome Cr. The magnetic characteristics of the respective materials are measured at 580° C. where the inner shield is blackened in the formed mask cathode ray tube, and at 460° C. where the inner shield is blackened in the tension mask cathode ray tube. The ratio 1 indicates a ratio of the specific value Br/Hc of the mask frame to the specific value Br/Hc of the inner shield, and the ratio 2 indicates a ratio of the specific value Br/Hc of the shadow mask to the specific value Br/Hc of the inner shield.

It is disclosed in U.S. Pat. No. 5,871,851 that the value obtained by multiplying the coercive force Hc by the residual magnetic flux density Br is a value for selecting the inner shield material. In the case when the specific value Hc×Br of the inner shield reaches 28 or more, the movement of the geomagnetic field can be minimized in the tension mask cathode ray tube. However, as estimated from Tables 2 and 3, with such a structure the selection of the inner shield material cannot be made in an effective manner.

For example, in the case of the comparative material 2, although the specific value Hc×Br of the inner shield greatly exceeds 28, the movement of the electron beam is not satisfactory.

As indicated in Table 3, inner shield materials where the movement of the electron beam is established to be a predetermined level of 40 $\mu$m or less are the comparative material 1 blackened at 460° C., and the comparative material 3.

Figure 6:
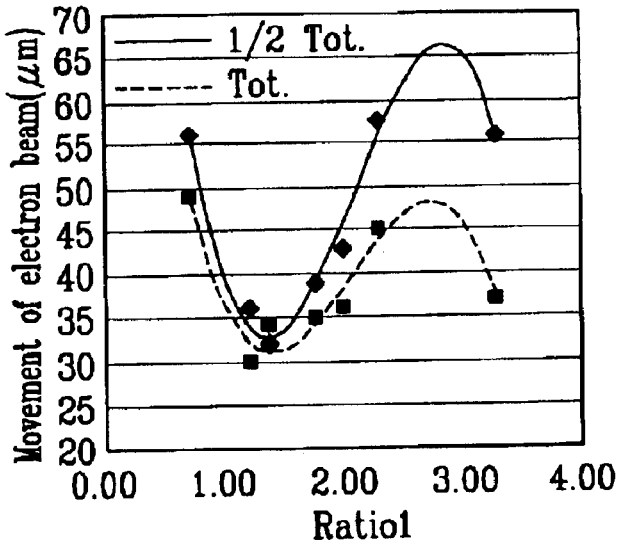
FIG. 6 is a graph illustrating the movement of the electron beam as a function of variation in the ratio of the characteristic value Br/Hc of the mask frame to the characteristic value Br/Hc of the inner shield, according to an embodiment of the present invention.
Figure 7:
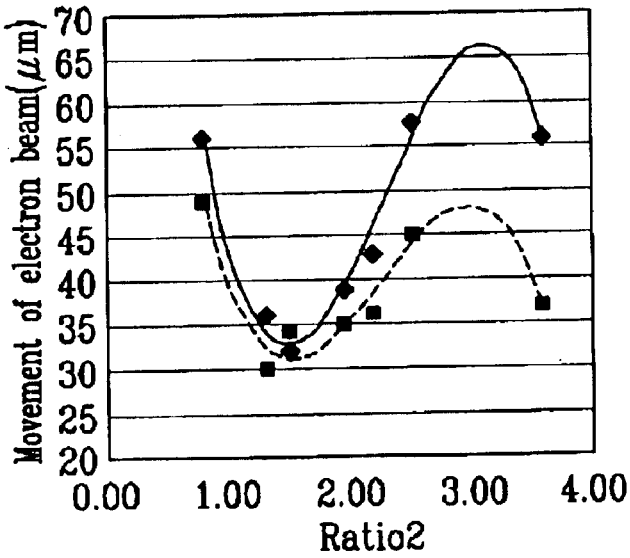
FIG. 7 is a graph illustrating the movement of the electron beam as a function of variation in the ratio of the characteristic value Br/Hc of the tension mask to the characteristic value Br/Hc of the inner shield, according to an embodiment of the present invention.

FIGS. 6 and 7 are graphs illustrating the relation of the movement of the electron beam to the ratios 1 and 2. In the graphs, the solid line indicates the value of 0.5(NS+EW), and the dotted line indicates the value of NS+EW.

As shown in FIGS. 6 and 7, the ratio 1 of the specific value Br/Hc of the mask frame to the specific value Br/Hc of the inner shield where the movement of the electron beam is established to be in the predetermined level or less is in the range of 1.0–2.0. The ratio 2 of the specific value Br/Hc of the tension mask to the specific value Br/Hc of the inner shield is in the range of 1.0–2.5.

Accordingly, among the comparative materials 1 to 4, those with the above-ranged ratios 1 and 2 are the comparative material 1 blackened at 460° C., and the comparative material 3. When the inner shield is made using the above materials, variation in the landing position of the electron beam due to geomagnetism can be minimized.

As described above, when the inner shield is made using a material where the ratio of the specific value Br/Hc of the mask frame to the specific value Br/Hc of the inner shield and the ratio of the specific value Br/Hc of the tension mask to the specific value Br/Hc of the inner shield are placed within a predetermined range, the route of the electron beams is established to be more precise. Consequently, the purity characteristic and the convergence characteristic are improved while forming a precise raster. In this way, the display screen quality can be enhanced.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A tension mask cathode ray tube comprising:

a vacuum tube having a panel with a phosphor screen, a funnel sealed to the panel, and a neck connected to the funnel;

an electron gun mounted within the neck for emitting electron beams;

a tension mask for color-selecting electron beams emitted from the electron gun;

a mask frame for holding the tension mask such that the tension mask is tensioned in a uni-axial direction or in a bi-axial direction;

a deflection yoke for deflecting the electron beams emitted from the electron gun; and an inner shield mounted within the vacuum tube to shield the vacuum tube from geomagnetism, wherein a value Br/Hc of the inner shield is 1.0–2.0 times more than a value Br/Hc of the mask frame, where Br indicates a residual magnetic flux density and Hc indicates a coercive force.

2. The tension mask cathode ray tube of claim 1 wherein the coercive force Hc of the mask frame is ≧3.0 Oe.

3. The tension mask cathode ray tube of claim 1 wherein the tension mask has a magnetic permeability of ≧300 at 350 mG.

4. The tension mask cathode ray tube of claim 1 wherein the inner shield has a thickness of 0.20–0.50 mm.

5. The tension mask cathode ray tube of claim 1 wherein the tension mask has a greater tensional strength at a periphery of the tension mask than at a center of the tension mask.

6. The tension mask cathode ray tube of claim 1 wherein the tension mask has a greater tensional strength at a center of the tension mask than at a periphery of the tension mask.

7. A tension mask cathode ray tube comprising:

a vacuum tube having a panel with a phosphor screen, a funnel sealed to the panel, and a neck connected to the funnel;

an electron gun mounted within the neck for emitting electron beams;

a tension mask for color-selecting electron beams emitted from the electron gun;

a mask frame for holding the tension mask such that the tension mask is tensioned in a uni-axial direction or in bi-axial directions;

a deflection yoke for deflecting the electron beams emitted from the electron gun; and an inner shield mounted within the vacuum tube to shield the vacuum tube from geomagnetism, wherein a value Br/Hc of the inner shield is 1.0–2.5 times more than a value Br/Hc of the tension mask, where Br indicates a residual magnetic flux density and Hc indicates a coercive force.

8. The tension mask cathode ray tube of claim 7 wherein the coercive force Hc of the mask frame is ≧3.0 Oe.

9. The tension mask cathode ray tube of claim 7 wherein the tension mask has a magnetic permeability of ≦300 at 350 mG.

10. The tension mask cathode ray tube of claim 7 wherein the inner shield has a thickness of 0.20–0.50 mm.

11. The tension mask cathode ray tube of claim 7 wherein the tension mask has a greater tensional strength at a periphery of the tension mask than at a center of the tension mask.

12. The tension mask cathode ray tube of claim 7 wherein the tension mask has a greater tensional strength at a center of the tension mask than at a periphery of the tension mask.

13. A tension mask cathode ray tube comprising:

a vacuum tube having a panel with a phosphor screen, a funnel sealed to the panel, and a neck connected to the funnel;

an electron gun mounted within the neck for emitting electron beams;

a tension mask for color-selecting electron beams emitted from the electron gun;

a mask frame for holding the tension mask such that the tension mask is tensioned in a uni-axial direction or in bi-axial directions;

a deflection yoke for deflecting the electron beams emitted from the electron gun; and an inner shield mounted within the vacuum tube to shield the vacuum tube from the geomagnetism, wherein a value Br/Hc of the inner shield is 1.0–2.0 times more than a value Br/Hc of the mask frame while being 1.0–2.5 times more than a value Br/Hc of the tension mask, where Br indicates a residual magnetic flux density and Hc indicates a coercive force.

14. The tension mask cathode ray tube of claim 13 wherein the coercive force Hc of the mask frame is ≧3.0 Oe.

15. The tension mask cathode ray tube of claim 13 wherein the tension mask has a magnetic permeability of ≦300 at 350 mG.

16. The tension mask cathode ray tube of claim 13 wherein the inner shield has a thickness of 0.20–0.50 mm.

17. The tension mask cathode ray tube of claim 13 wherein the tension mask has a greater tensional strength at a the periphery of the tension mask than at a center of the tension mask.

18. The tension mask cathode ray tube of claim 13 wherein the tension mask has a greater tensional strength at a center of the tension mask than at a periphery of the tension mask.

* * * * *